US011571079B1

(12) United States Patent
Faizan et al.

(10) Patent No.: US 11,571,079 B1
(45) Date of Patent: Feb. 7, 2023

(54) PACKAGE DELIVERY BOX

(71) Applicant: Mirza Faizan, Irving, TX (US)

(72) Inventors: Mirza Faizan, Irving, TX (US); Isha Agrawal, Plano, TX (US); Carcyn Coleman, Grand Prairie, TX (US); Aiza Gaffar, Plano, TX (US); Daniel Syed, Richardson, TX (US); Sooryavanshi Narayanan, Frisco, TX (US); Anika Prasad, Frisco, TX (US); Mirza Rizwan, Patna (IN); Hisham Ahmad, Allen, TX (US); Saadia Asaf, Aligarh (IN); Mansoor Hasan Khan, Aligarh (IN)

( * ) Notice: Subject to any disclaimer, the term of this patent is extended or adjusted under 35 U.S.C. 154(b) by 0 days.

(21) Appl. No.: 17/460,241

(22) Filed: Aug. 29, 2021

(51) Int. Cl.

| | |
|---|---|
| ***A47G 29/20*** | (2006.01) |
| ***E05C 1/08*** | (2006.01) |
| ***E05F 1/02*** | (2006.01) |
| ***A47G 29/30*** | (2006.01) |

(52) U.S. Cl.
CPC ..... *A47G 29/20* (2013.01); *A47G 29/30* (2013.01); *E05C 1/08* (2013.01); *E05F 1/02* (2013.01)

(58) Field of Classification Search
CPC ..... A47G 29/20; A47G 29/30; A47G 29/141; A47G 2029/1228; E05C 1/08; E05F 1/02; E05B 47/026; E05B 55/00
USPC ..... 232/17, 19, 45; 70/141; 292/144
See application file for complete search history.

(56) References Cited

U.S. PATENT DOCUMENTS

| | | | | |
|---|---|---|---|---|
| 10,993,567 | B1 * | 5/2021 | Cabral-McKeand | A47G 29/141 |
| 11,197,568 | B2 * | 12/2021 | Pillman | A01G 9/02 |
| 11,497,335 | B2 * | 11/2022 | Romanucci | B64F 1/32 |
| 2005/0253715 | A1 * | 11/2005 | Awobue | A47G 29/124 340/569 |
| 2009/0166403 | A1 * | 7/2009 | Volpe | G07C 9/00912 235/375 |
| 2016/0230421 | A1 * | 8/2016 | Cochran | A47G 29/124 |
| 2017/0191287 | A1 * | 7/2017 | Mittleman | E05B 41/00 |
| 2018/0070753 | A1 * | 3/2018 | Eveloff | H04W 4/025 |
| 2021/0015286 | A1 * | 1/2021 | McCloskey, III | A47G 29/22 |
| 2021/0251409 | A1 * | 8/2021 | Kennett | A47G 29/141 |
| 2021/0298508 | A1 * | 9/2021 | Chowdhury | H04L 9/3226 |
| 2022/0151421 | A1 * | 5/2022 | Sengstaken, Jr. | G06K 7/10544 |

FOREIGN PATENT DOCUMENTS

CN 2596894 Y * 1/2004

* cited by examiner

*Primary Examiner* — William L Miller

(57) ABSTRACT

A package delivery box 100 is disclosed. It comprises a container 101 for accommodating at least one package, an openable lid 102 attached to the container 101, a closing mechanism for closing the container 101, and a locking mechanism for locking the closed container 101. The closing mechanism comprises a pressure plate 103 at a base of the container 101, a string 105 connecting the pressure plate 103 with the lid, and at least one pull spring 106 between the lid 102 and the container 101, and the locking mechanism comprises a flexible rod 104 beneath the pressure plate 103 and directly connected to the pressure plate 103, a slider 109 connected to the flexible rod, and a hole 110 in the lid, wherein the hole 110 is adapted to accommodate insertion of the flexible rod 104 therein.

10 Claims, 3 Drawing Sheets

PACKAGE DELIVERY BOX

FIELD OF THE INVENTION

The present invention relates to a package delivery box, and particularly, a package delivery box with a locking mechanism that securely holds the package and prevents theft without causing any damage and posing no potential risk.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

More than 5.5 million cases of package theft have been reported (according to recent study) and it is estimated that the combined value of the products taken in 2017 is $6 billion. This has caused people to lose many important items and lots of money.

As per the statistics, 36% of Americans have had packages stolen from their front porch. The data is similar for almost all the nations. Between Thanksgiving and New years day, an estimated 800 million packages are shipped within the United States (combined with the previous statistic that would be 288 million packages taken within this time). More than 5.5 million cases have been reported (according to most recent study). The estimated combined value of the products taken in 2017 is $6 billion. In fact, 41% of americans have avoided buying something online to prevent theft.

It has been seen that camera doorbells that keep eye on the door while ringing, help but it is not enough to deal with the problem of theft for many reasons. The camera might be disconnected or shadowed, etc.

Therefore, there arises a need to provide a package delivery box, and particularly, a package delivery box that can be kept at the door. The package delivery box may have a locking mechanism that prevents theft or unwarranted access to the packages placed therein.

OBJECTIVE OF THE INVENTION

The present disclosure is aimed at providing a package delivery box that securely holds the package and prevents theft.

Another object of the present invention is to provide a package delivery box that prevents damage of the package posing no potential risk.

Yet another object of the present invention is to provide a package delivery box that is portable, economic and easy to install and reinstall.

SUMMARY OF THE INVENTION

This summary is provided to introduce a selection of concepts in a simplified format that are further described in the detailed description of the present disclosure. This summary is not intended to identify key or essential inventive concepts of the present disclosure, nor is it intended for determining the scope of the present disclosure.

According to an embodiment of the present disclosure, a package delivery box, comprises a container for accommodating at least one package; an openable lid attached to the container; a closing mechanism for closing the container; and a locking mechanism for locking the closed container, wherein the closing mechanism comprises a pressure plate at a base of the container, a string connecting the pressure plate with the lid, and at least one pull spring between the lid and the container, and wherein the locking mechanism comprises a flexible rod beneath the pressure plate and directly connected to the pressure plate, a slider connected to the flexible rod, and a hole in the lid, wherein the hole is adapted to accommodate insertion of the flexible rod therein.

According to an embodiment, the slider is a mechanical part slidably movable and adapted to convert straight-line motion to rotary motion and/or rotary motion to straight line motion, and wherein the slider slides towards the hole in a locking position.

According to an embodiment, the package delivery box comprises an arduino board adapted to control the lid based on the movement in the box.

According to an embodiment, the package delivery box comprises a plurality of compartments, each of the plurality of compartments accommodating one or more packages.

According to an embodiment, each of the compartments of the plurality of compartments comprises an individual closing and locking mechanism.

According to an embodiment, the package delivery box comprises additional compartments to accommodate umbrella, shoe rack, and other personalized add-ons.

According to an embodiment, the package delivery box comprises an ultraviolet sterilizer directing ultraviolet radiations on the packages in the box.

According to an embodiment, the package delivery box is unlocked by a key, and wherein the key is inserted into a locking component on an outer surface of the box.

According to an embodiment, in the locked position, the flexible rod is inserted into the hole in the lid and the slider is positioned by the side of the hole, and in the unlocked position, the flexible rod is pulled out of the hole in the lid and the slider is positioned away from the side of the hole.

According to another embodiment of the present invention, a package delivery box, comprises a container for accommodating at least one package; an openable lid attached to the container; a closing mechanism for closing the container; and a locking mechanism for locking the closed container. The closing mechanism comprises an electric pressure plate at a base of the container and a motor connected to the electric pressure plate, the motor is adapted to pull the lid. The locking mechanism comprises a flexible rod beneath the pressure plate and directly connected to the pressure plate, a slider connected to the flexible rod, and a hole in the lid, wherein the hole is adapted to accommodate insertion of the flexible rod therein.

BRIEF DESCRIPTION OF DRAWINGS

To further clarify the advantages and features of the present disclosure, a more particular description of the disclosure will be rendered by reference to specific embodiments thereof, which is illustrated in the appended drawings. It is appreciated that these drawings depict only typical embodiments of the disclosure and are therefore not to be considered limiting of its scope. The disclosure will be described and explained with additional specificity and detail with the accompanying drawings.

The subject matter that is regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

Figure 1:
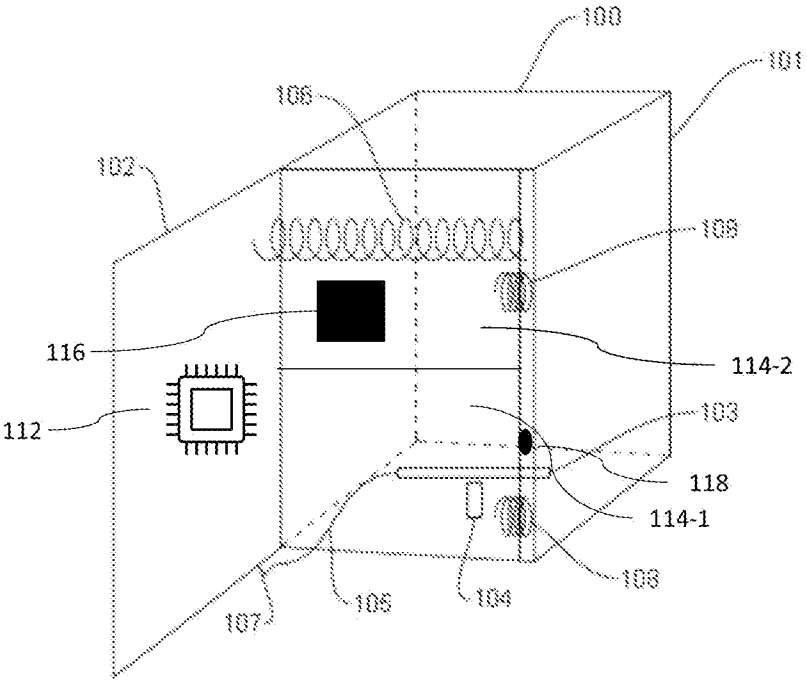
FIG. 1 illustrates a closing mechanism of a package delivery box, according to an embodiment of the present invention.

Further, skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF THE INVENTION

For the purpose of promoting an understanding of the principles of the invention, reference will now be made to the embodiment illustrated in the drawings, and specific language will be used to describe the same. It will nevertheless be understood that no limitation of the scope of the invention is thereby intended. Such alterations and further modifications in the illustrated system, and such further applications of the principles of the invention as illustrated therein would be contemplated as would normally occur to one skilled in the art to which the invention relates. Unless otherwise defined, all technical and scientific terms used herein have the same meaning as commonly understood by one of ordinary skilled in the art. The system, methods, and examples provided herein are illustrative only and are not intended to be limiting.

The term "some" as used herein is to be understood as "none or one or more than one or all." Accordingly, the terms "none," "one," "more than one," "more than one, but not all" or "all" would all fall under the definition of "some." The term "some embodiments" may refer to no embodiments or to one embodiment or to several embodiments or to all embodiments, without departing from the scope of the present disclosure.

The terminology and structure employed herein is for describing, teaching, and illuminating some embodiments and their specific features. It does not in any way limit, restrict or reduce the spirit and scope of the claims or their equivalents.

More specifically, any terms used herein such as but not limited to "includes," "comprises," "has," "consists," and grammatical variants thereof do not specify an exact limitation or restriction and certainly do not exclude the possible addition of one or more features or elements, unless otherwise stated, and furthermore must not be taken to exclude the possible removal of one or more of the listed features and elements, unless otherwise stated with the limiting language "must comprise" or "needs to include."

Whether or not a certain feature or element was limited to being used only once, either way, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language such as "there needs to be one or more . . . " or "one or more element is required."

Unless otherwise defined, all terms, and especially any technical and/or scientific terms, used herein may be taken to have the same meaning as commonly understood by one having ordinary skills in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not be necessarily taken as limiting factors to the attached claims. The attached claims and their legal equivalents can be realized in the context of embodiments other than the ones used as illustrative examples in the description below. Embodiments of the present invention will be described below in detail with reference to the accompanying drawings.

The present invention provides a package delivery box 100 (interchangeable used as "box" 100) with a locking mechanism that securely holds the package and prevents theft without causing any damage and posing no potential risk. The package delivery box 100 may be installed outside a home, an office or any other premises where the packages are delivery received. In an embodiment, the package delivery box 100 may be attached to a front porch floor by screws. In another embodiment, the package delivery box 100 may be connected to the floor by any means such that the box 100 is not movable and cannot be taken out from the floor without any mechanical force being used. In an embodiment, the box 100 may me fixed to the floor by four screws, each making sure that the box 100 itself may not be taken from the front of the house. In another embodiment, the box 100 may comprise six screws to ensure the user has extra screws, if needed. When the package may be placed on the box 100, the box 100 may first actuate closing mechanism and then locking mechanism, finally locking the package in the box 100. The box 100 may be said to be closed when a container 101 accommodating the packages is closed. To move the box 100 from one location to another location, the box 100 may simply need to be unscrewed from its respective surface and screwed on to the new one.

FIG. 1 illustrates a closing mechanism of a package delivery box 100, according to an embodiment of the present invention. The box 100 may comprise closed structure or a container 101 with an open face that may accommodate the package. The open face may be placed such that it may form a lid 102 covering the container 101, but may be openable. The size of the container 101 may vary depending on the size of the packages that are to be placed in it. The box 100 may contain a pressure plate 103 at the place where the package is to be paced. In an embodiment, the container 101 may be a cube or a cuboidal structure with one of the faces open and having a pressure plate 103 beneath the open face. Therefore, when the package may be placed, it may hit the pressure plate 103. Referring to FIG. 1, the pressure plate 103 may be connected through a string 105 to the lid. One of the ends of the string 105 may be connected to the lid 102 by at least one hook 107 while the other end of the string 105 may be connected to the pressure plate 103. When the package is placed on the pressure plate 103, pressure plate 103 lowers due to the pressure posed by the package. The string 105 attached to the pressure plate 103 and the lid 102 may also lower. Further, there may be a flexible rod 104 placed beneath the pressure plate 103, such that when the pressure plate 103, and the string 105 lowers, the flexible rod 104 directly attached to the pressure plate 103 and the top of the lid, may also come down. The pull spring 106 may provide momentum to the lid 102 to come down to closing position. As the flexible rod 104 comes down, the lid 102 may also come down such that it closes the box 100. Therefore, when a package may be placed in the container 101, the lid 102 of the box 100 may be closed.

In other words, the closing mechanism includes a few push and pull springs, hook 107, string 105, flexible rod 104 and a pressure plate 103. When the pressure plate 103 gets pushed down from the package or object, the string 105 that is connected to the hook 107 will go down causing the hook 107 to go down. Then the lid 102 gets pulled due to a very tight spring at the top of the box 100 otherwise known as the pull spring 106. Then the locking mechanism attached under the push spring 108 locks it into place. The push springs 108 on either side then push the box 100 back out once the owner opens the box 100 with a key.

There are chances that animals may enter the box 100 and the box 100 may be closed as the pressure plate 103 lowers due to the weight of the animal. However, the animal in the box 100 may move around, touching and hitting things and making movements. There may be an Arduino board 112 in the box 100. The Arduino board may control the lid 102 of the box 100 based on the movement in the box 100. In case, there is a movement detected in the box 100, the lid 102 of the box 100 may open and the animal may then escape the box 100. For opening the box 100, there may be a push button 111 (as shown in FIG. 2*a*) connected to a servo motor placed in a way that it may keep the box 100 closed but may be able to open the box 100. When the push button 111 (as shown in FIG. 2*a*) is pressed, the box 100 may be opened.

In another embodiment, there may be an electrical version of the package delivery box 100. The said version may include a simple electrical pressure plate 103 connected to the lid. Further, a motor may be activated to close the lid 102 when the pressure plate 103 senses weight on it. Therefore, when the package may be placed in the box 100, the electrical pressure plate 103 may lower and the motor connected to the pressure plate 103 may let the lid 102 to lower and cover the box 100, thereby closing it.

In an embodiment, there may be more than one compartment in the box 100 adapted to accommodate multiple packages in s single box. The size and number of compartments in a box 100 may vary depending on the requirement of the user, type of premises, manufacturer designs, etc. On an average, Amazon Prime members buy 51 packages every year resulting in $6 billion of lost goods and services every year. An average 26% of Americans receive packages every week. This brings up the question of if a consumer receives multiple packages, then how will our innovation protect all the packages, Considering said problem, the box 100 with more than one compartment may be installed where either the frequency of the delivery of packages if high or multiple packages are delivered at a time. In an embodiment, the user may be allowed to select and purchase their desired number of boxes in various sizes. The user may purchase from 1 to 10 number of compartments and may choose whether they would like to buy the small size, the standard size, or the large size. Each box 100 bought may be an individual product therefore operating alone. The use and closure of one box 100 may not close another and therefore may keep empty product open to receive packages. In an embodiment, the user may be presented with three sizes of the box 100, namely, small, standard and large. The standards of the sizes may be fixed by the manufacturer centrally for the ease of the users. The box 100 may be also be adapted to accommodate personalized add-ons. In an embodiment, the personalized add-ons may include but not limited to an umbrella stand, a shoe rack, etc.

Recently, Covid-19 has adversely affected the world and the human kind is under fear of the virus. As a result of the virus, people have chosen to wipe and thoroughly clean their packages before they enter the house. Unfortunately, this cannot be effectively done by hand. It has been seen that the UV lights may be an efficient way to clean or disinfect an area and will be very useful when trying to disinfect air and mucus before entering the environment. Many countries use UV lights to disinfect areas around their companies. Some hospitals even have new technology using UV lighting to disinfect areas around the hospitals. UV radiation has three wavelength zones: UV-A, UV-B, and UV-C. UV radiation alters the DNA of the bacteria essentially "killing" them and rendering them harmless. UV radiation can be harmful when in direct contact with skin for prolonged periods of time, but has been proven to work in order to sterilize the area. Therefore, the box 100 may include an ultra violet sterilizer directing ultraviolet rays capable of killing bacteria on the packages, thus making the package clean and bacteria free. This way, the user may not have to fetch the package the package from the box 100 and sanitize it afterwards to make it free from virus that may reside on the surface of the package. This may take about 9 seconds to completely clean/sterilize the package, according to an embodiment. This may insure the safety of the package and may keep any viruses and bacteria away from the package. It may do this by changing or affecting the DNA of the virus or bacteria which then "deactivates" it making it impossible to attach to the host or living being.

Figure 2:
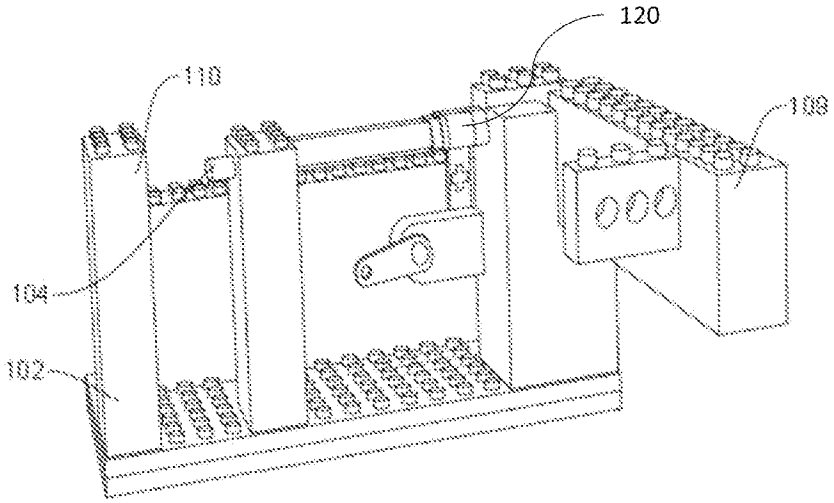
FIGS. 2 and 2*a* illustrates a locking mechanism of a package delivery box, according to an embodiment of the present invention.
Figure 2A:
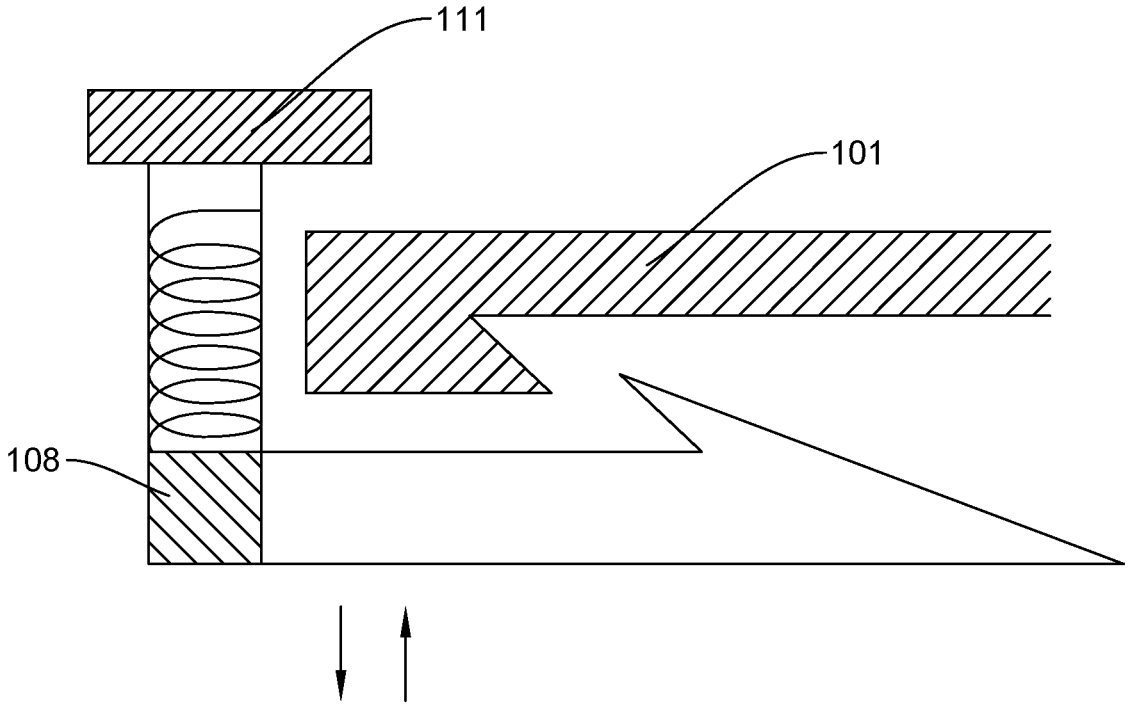

FIG. 2 and FIG. 2*a* illustrates a locking mechanism of a package delivery box 100, according to an embodiment of the present invention. In an embodiment, the locking mechanism may be placed right under the push spring 108 (as shown in FIG. 2*a*), the push spring 108 providing momentum for the opening of the box 100. There may be a slider 109 (as shown in FIG. 2), a flexible rod, and a hole 110 in the lid 102 of the box 100. The hole 110 may be such that it may accommodate the flexible rod 104 without letting it slip. The flexible rod 104 may be advancing from a surface of the slider 109. Once the lid 102 is closed, the slider 109 may cause the flexible rod 104 to slide into the hole 110 in the lid. Since the flexible rod 104 is inserted into the hole 110 in the lid, the lid 102 may not move and may be secured. In such situation, the lid 102 cannot be opened from the outside of the box 100 and the same has been secured from the inside of the box 100. However, explained above, animals may be able to open the lid 102 from inside with an Arduino board, if they are struck inside.

In another embodiment, there may be motion sensors in the box 100 adapted to sense the motion, if any, made by an animal in the box 100. When the motion may be detected, the lid 102 of the box 100 may open up allowing the animal inside to move out of the box 100.

The slider 109 (as shown in FIG. 2) that initially activates the locking mechanism may be triggered when the lid 102 is closed. Once the lid 102 is closed, the slider 109 may slide onto a side thus causing the flexible rod 104 to be locked into the hole 110. The flexible rod 104 may not be pulled out of the hole 110 till the slider 109 is in said position. In other words, there may be a closed state when the lid 102 is closed. The flexible rod 104 advancing from the lid 102 may then slide into the hole 110 of the lid 102 and be inserted therein. The slider 109 may then move to a side such as to lock the flexible rod 104 in the hole 110. The flexible rod 104 may not be slide out on its own from inside from the hole 110. This may be a locked state of the box 100.

Further, for opening the box 100, there may be a push button 111 (as shown in FIG. 2*a*) connected to a servo motor placed in a way that it may keep the box 100 closed but may be able to open the box 100. When the push button 111 (as shown in FIG. 2*a*) is pressed, the box 100 may be opened.

According to an embodiment, the unlocking of the locked box 100 may be so simple and may be done by a key. A locking component 118 may be on the outside of the box 100 and a part where the key may be inserted may be easily accessible by the user. Therefore, the locking may be automatic and coupled to the closing of the box 100. However, the unlocking may be done by the user by with a key. The user may insert the key in the locking component and rotate or move the key so as to cause the slider 109 to slide to its initial state and away from the side of the hole 110. Once the slider 109 may be moved, the flexible rod 104 may be pulled out of the hole 110 in the lid 102 and the lid 102 may be lifted up then, opening the box 100. In an embodiment, there may be the locking component comprising a solid block followed by a spring, and rather blocking the spring. The solid block may be horizontally connected to a horizontal base, forming an L-shaped structure. The horizontal base mat have a hooked corner adapted to hook an edge of the container 101. When the spring may be pushed down from top, the solid block may be removed due to the external force supplied thereon and the spring may move downwards, and the hooked connection may distort, releasing the container (FIG. 2*a*). The solid block may have to be inserted again along the spring to close the container 101 and lock it thereat.

The present disclose may prove a package delivery box 100 that is secured to the premises it is installed on and cannot be stolen or taken easily. Further, it is easy to install and does not even damage the property (premises) of the user. Since, the construction of the box 100 is easy and it allows the user to protect their packages from being theft or misplaced, the disclosed technology offers certain economic viability. The box 100 is also easy to operate and the use may easily unlock the box 100 to receive the packages.

The figures and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of the embodiments is by no means limited by these specific examples. Numerous variations, whether explicitly given in the specification or not, such as differences in structure, dimension, and use of material, are possible.

We claim:

1. A package delivery box (100) comprising:

a container (101) for accommodating at least one package;

an openable lid (102) attached to the container (101);

a closing mechanism for closing the container (101); and a locking mechanism for locking the closed container (101), wherein the closing mechanism comprises a pressure plate (103) at a base of the container (101), a string (105) connecting the pressure plate (103) with the lid, and at least one pull spring (106) between the lid (102) and the container (101), and wherein the locking mechanism comprises a flexible rod (104) beneath the pressure plate (103) and directly connected to the pressure plate (103), a slider (109) connected to the flexible rod, and a hole (110) in the lid, wherein the hole (110) is adapted to accommodate insertion of the flexible rod (104) therein.

2. The package delivery box (100) as claimed in claim 1, wherein the slider (109) is a mechanical part slidably movable and adapted to convert straight-line motion to rotary motion and/or rotary motion to straight line motion, and wherein the slider (109) slides towards the hole (110) in a locking position.

3. The package delivery box (100) as claimed in claim 1, wherein the package delivery box (100) comprises an arduino board (112) adapted to control the lid (102) based on the movement inside the container (101).

4. The package delivery box (100) as claimed in claim 1, wherein the package delivery box (100) comprises a plurality of compartments (114-1, 114-2), each of the plurality of compartments (114-1, 114-2) accommodating one or more packages.

5. The package delivery box (100) as claimed in claim 4, wherein each of the compartments of the plurality of compartments comprises an individual closing and locking mechanism (103, 104).

6. The package delivery box (100) as claimed in claim 1, wherein the package delivery box (100) comprises additional compartments (114-2) to accommodate umbrella, shoe rack, and other personalized add-ons.

7. The package delivery box (100) as claimed in claim 1, wherein the package delivery box (100) comprises an ultraviolet sterilizer (116) directing ultraviolet radiations on the packages in the container (101).

8. The package delivery box (100) as claimed in claim 1, wherein the package delivery box (100) is unlocked by a key, and wherein the key is inserted into a locking component (118) on an outer surface of the package delivery box (100).

9. The package delivery box (100) as claimed in claim 1, wherein in the locked position, the flexible rod (104) is inserted into the hole (110) in the lid (102) and the slider (109) is positioned adjacent to the hole (110), and wherein in the unlocked position, the flexible rod (104) is pulled out of the hole (110) in the lid (102) and the slider (109) is positioned away from the hole (110).

10. A package delivery box (100), comprising:

a container (101) for accommodating at least one package;

an openable lid (102) attached to the container (101);

a closing mechanism for closing the container (101); and a locking mechanism for locking the closed container (101), wherein the closing mechanism comprises an electric pressure plate (103) at a base of the container (101) and a motor (120) connected to the electric pressure plate (103), wherein the motor (120) is adapted to pull the lid, and wherein the locking mechanism comprises a flexible rod (104) beneath the pressure plate (103) and directly connected to the pressure plate (103), a slider (109) connected to the flexible rod, and a hole (110) in the lid, wherein the hole (110) is adapted to accommodate insertion of the flexible rod (104) therein.

* * * * *